US006240660B1

(12) United States Patent
Dugas

(10) Patent No.: US 6,240,660 B1
(45) Date of Patent: Jun. 5, 2001

(54) SNOW BLADE ATTACHMENT

(76) Inventor: Gerard F. Dugas, c/o Dugas Welding Inc., P.O. Box 189, Navan, Ontario (CA), K4B 1J4

( * ) Notice: Subject to any disclaimer, the term of this patent is extended or adjusted under 35 U.S.C. 154(b) by 0 days.

(21) Appl. No.: 09/233,877

(22) Filed: Jan. 20, 1999

(30) Foreign Application Priority Data

Jan. 22, 1998 (CA) ..... 2227863

(51) Int. Cl.[7] ..... E01H 5/06
(52) U.S. Cl. ..... 37/280; 37/281; 37/903
(58) Field of Search ..... 37/196, 219, 274, 37/281, 444, 903, 280; 172/509, 272

(56) References Cited

U.S. PATENT DOCUMENTS

| | | | | |
|---|---|---|---|---|
| 2,515,384 | * | 7/1950 | Von Carnop | 37/409 |
| 2,841,897 | * | 7/1958 | Duke | 172/815 |
| 2,988,831 | * | 6/1961 | Burns | 37/280 |
| 3,055,126 | | 9/1962 | Emhof . | |
| 3,208,166 | | 9/1965 | Proulx . | |
| 3,373,515 | * | 3/1968 | Schneider | 37/280 |
| 4,127,951 | * | 12/1978 | Hatch | 172/272 |
| 4,208,812 | | 6/1980 | Brownly . | |
| 4,446,639 | | 5/1984 | Bohn . | |
| 4,962,600 | * | 10/1990 | Zellaha et al. | 37/274 |
| 5,375,349 | * | 12/1994 | Jochim | 37/903 |
| 5,692,855 | * | 12/1997 | Burton | 172/272 |
| 5,692,875 | * | 12/1997 | Boman | 37/903 |
| 5,848,654 | * | 12/1998 | Belcher, Jr. | 37/274 |
| 5,903,986 | * | 5/1999 | Parker | 37/281 |

FOREIGN PATENT DOCUMENTS

| | | |
|---|---|---|
| 741065 | 8/1966 | (CA) . |
| 759663 | 5/1967 | (CA) . |
| 1040854 | 10/1978 | (CA) . |

* cited by examiner

*Primary Examiner*—Robert E. Pezzuto
*Assistant Examiner*—Nathan Mammen
(74) *Attorney, Agent, or Firm*—Woodard, Emhardt, Naughton, Moriarty & McNett

(57) ABSTRACT

An attachment for use with snow handling equipment such as a snowplow blade or a wheel loader bucket or similar implement, the attachment comprising a plate pivotally mounted at each end of the implement and movable between a forwardly projecting horizontal deployed position and a retracted position wherein the plate extends upwardly and does not interfere with normal operation of the implement. In the deployed position the plate is freely pivotal upwards and has a rounded front lower corner so that it can readily ride over curb stones and similar obstacles without damaging the mechanism. The attachments have the effect of greatly increasing the snow handling capacity of the implement without significantly detracting from its normal utilization.

20 Claims, 9 Drawing Sheets

SNOW BLADE ATTACHMENT

BACKGROUND OF THE INVENTION

1. Field of the Invention

This invention relates to a new or improved attachment for use with snow handling equipment, and in particular although not exclusively to an attachment for mounting on the ends of a snow pusher blade to effect an increase in the volume of snow which can be contained in front of the blade. The invention is also useful to provide attachments which can be mounted on similar equipment such as the bucket of a wheeled loader or the sides of a snow thrower machine.

2. Description of the Prior Art

In regions which experience significant snowfalls, a great deal of energy and expense is required to clear snow off the surfaces of roads, laneways, driveways and parking lots. Roadways can be kept clear of snow by making successive passes with heavy duty snowplows which have angled blades which displace the snow laterally to one side of the snowplow in a continuous pass of the latter along the roadway. However parking lots and the like often cannot be cleared of snow in the same manner. Often it is necessary to utilize a snowplow blade carried on a vehicle to clear the snow from across the parking lot to one location where it can be formed into a heap, and perhaps later removed by truck. The quantity of snow that can be displaced or pushed in front of a transversely arranged snowplow blade is severely limited and if a large amount of snow is involved the maximum holding capacity of the blade is exceeded and excess snow spills from both ends of the blade thus making necessary numerous additional passes of the blade before the surface can be satisfactorily cleared. To some extent this difficulty can be overcome by increasing the length of the blade, but this solution comes at a cost in terms of moneuverability.) A very wide blade will not be able to operate effectively in constricted locations, e.g. in attempting to clear snow between parked cars in a parking lot.

The aim of the present invention is to provide an improved snow clearing apparatus which will increase the capacity of snow that can be handled without significantly affecting the moneuverability of the snowplow or the vehicle upon which it is carried.

SUMMARY OF THE INVENTION

The invention provides an attachment for mounting on an end of a transversely elongate implement that is useful for pushing loose friable material across a ground surface, said attachment being deployable to increase the material-handling capacity of said implement and comprising: a mounting bracket adapted to be fixed on said implement to define a pivot axis that is generally parallel to the length of said implement; a plate pivotally carried on said mounting bracket for angular movement about said pivot axis; and abutment means operatively associated with said plate and said mounting bracket and positioned to delimit said angular movement and define a first limiting position wherein said plate in operation occupies a deployed position in a generally upright plane with a major part of said plate at an attitude projecting forwardly of said implement; said plate being freely pivotable upwardly from said deployed position.

The free pivotal mounting of the plate enables it to accommodate readily to changes in slope of the surface on which the attachment is operated. For example if a vehicle equipped with the attachment passes from a downwardly inclined surface to a horizontal surface, upon meeting the latter the plate will pivot upwardly and thus avoid gouging into the horizontal surface. Preferably the front lower corner of the plate is rounded at a large radius so that when in use the plate encounters a step or a curb, the plate can pivot upwardly freely to avoid damage which might otherwise be occasioned by impact with such an obstruction.

Preferably the plate has a range of pivotal movement from its deployed position through at least about 90° to a retracted position, and a latch arrangement is provided to secure the plate in its retracted position so that the implement on which it is attached can be used in a normal mode of operation without interference from the plate. The latching means can be spring loaded and arranged to operate automatically upon movement of the plate to the retracted position. Alternatively a powered actuator can be provided to control the latching arrangement.

The invention also includes an implement such as a snowplow blade in combination with a pair of attachments as discussed above, arranged one at each end of the snowplow blade. Such snowplow blades are usually employed in combination with light trucks, being mounted on usually the forward end but sometimes the rear end of such trucks and normally controlled for vertical displacement thereon. When not required the plates of the attachments can be pivoted upwardly to their retracted positions where they are latched, allowing the snowplow blade to be used in its normal mode of operation. Movement of the plates from the latched to the deployed position is effected manually and can be done quickly.

Mounting of the attachment on the ends of a standard snowplow blade can be effected relatively simply by welding a horizontal bracket at each end of the rear side of the blade, the bracket having a socket for receiving a horizontal pivot pin that is attached to the plate. The deployed position of the plate can be defined simply by a lug on the upper rear portion of the plate which is adapted to engage against the rear side of the blade. The latching means can simply be a horizontal pin on the upper rear part of the blade which is positioned to engage into a hole which is suitably positioned near the front end of the plate.

Wheeled mobile loaders having large capacity buckets are often used in snow clearing operations, particularly where the snow has to be loaded into trucks for transport to a dump site. One embodiment of the invention is specifically designed for use with the bucket of such a loader and comprises at each end of the bucket a mounting bracket in the form of a plate that is secured to the cheek of the loader bucket along the front end of the cheek (which can be reinforced by addition of a strengthening plate) and also near the rear of the cheek. Since it is not permissible to obstruct the interior space of the bucket by an elongate mounting bracket, the pivot axis in this arrangement is defined by an axially-short large-diameter bearing on the mounting plate received within a similar shaped opening in the attachment plate, there being abutment means acting between the mounting plate and the attachment plate to define a range of pivotal movement delimited by a deployed position and a retracted position. Latching means in this arrangement is preferably provided by a powered actuator controlling a pin engageable with an aperture in the attachment plate. Movement of the attachment plate between its deployed and retracted positions can be effected by tilting the bucket about a horizontal axis using the bucket mounting control linkage, the attachment plate being acted upon by gravity to be moved in the desired direction in response to such tilting of the bucket.

BRIEF DESCRIPTION OF THE DRAWINGS

The invention will further be described, by way of example only, with reference to the accompanying drawings wherein.

DESCRIPTION OF THE PREFERRED EMBODIMENTS

Figure 1:
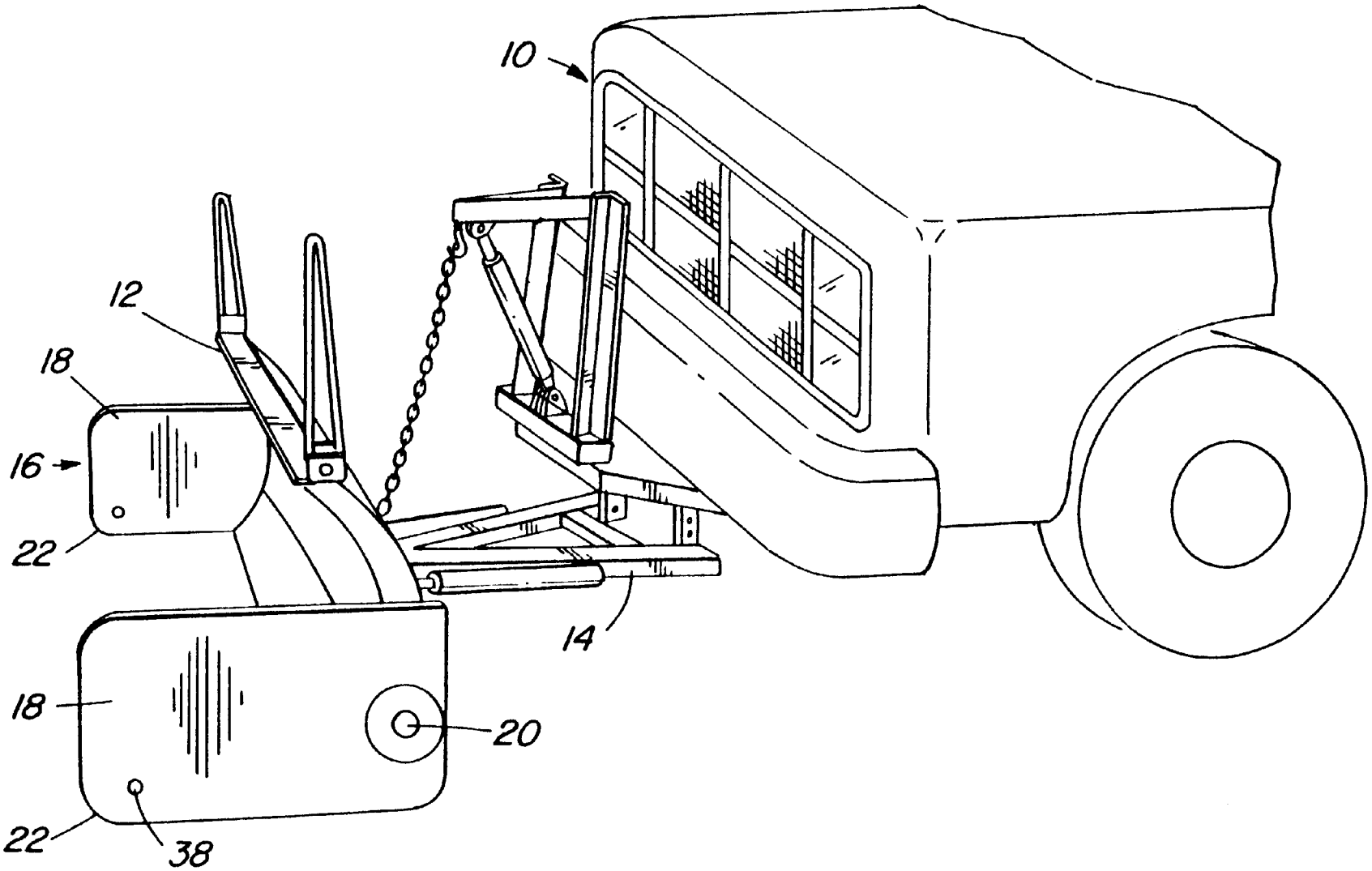
FIG. 1 is a somewhat schematic view of an embodiment of the invention shown mounted on a snowplow blade carried by a light truck.

Referring to FIG. 1, a light truck that is schematically indicated at 10 carries at the front end thereof a horizontal transversely arranged snowplow blade 12 supported on the truck by a linkage 14 which is capable of limited movement, e.g. to effect raising and lowering of the snowplow blade. At each end of the snowplow blade is an attachment 16 in accordance with the present invention. Each attachment 16 comprises a vertically oriented plate 18 carried on a horizontally projecting pivot pin 20 which is fixed thereto as by welding, the pin being located near the rear end of the plate, and the plate having a rectangular outline as shown with a rounded lower front corner 22. Near the upper end of the rear edge of the plate is a laterally inwardly projecting lug 24.

On the rear side of the snowplow blade a metal sleeve 26 is affixed in a horizontal orientation, this sleeve being designed to receive the pivot pin 20 in rotatable fashion. In the installed condition an annular groove 28 near the free end of the pivot pin is engaged by a locking pin 30 which is insertable through the sleeve 26 to the position shown in FIG. 2.

When thus installed, the plate 18 is freely rotatable on the blade 12 about the axis of the pivot pin 20. The lug 24 on the plate is positioned to cooperate with the rear edge 32 of the snowplow blade 12 to define a limiting position in the range of pivot of movement, this limiting position corresponding to the deployed position wherein the plate 18 extends forwardly of the blade 12, the lower edge of the plate being substantially horizontal, and the plate being urged into this position by the force of gravity.

Figure 2:
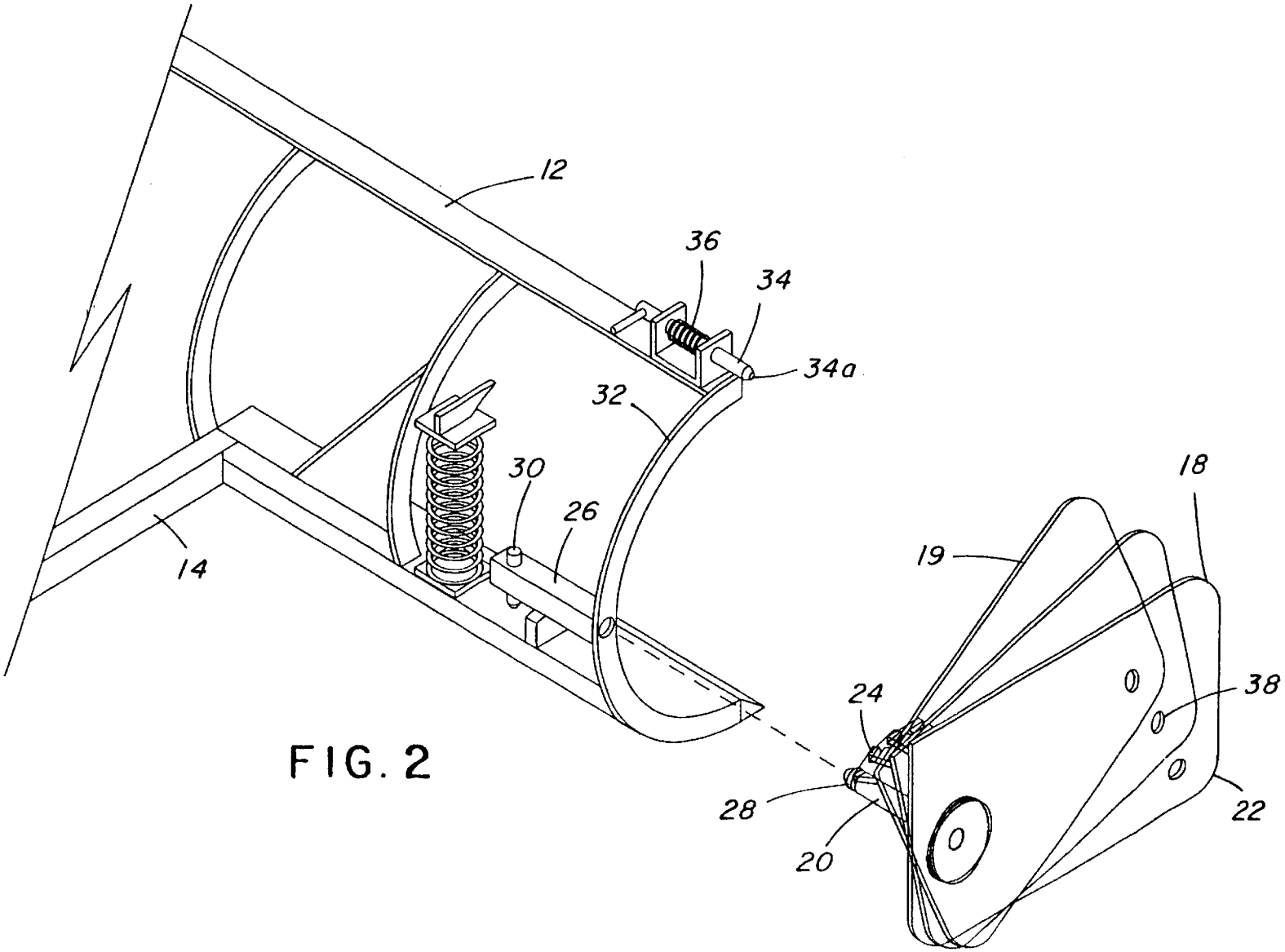
FIG. 2 is an exploded fragmentary rear perspective view showing a portion of the snowplow blade.
Figure 3A:
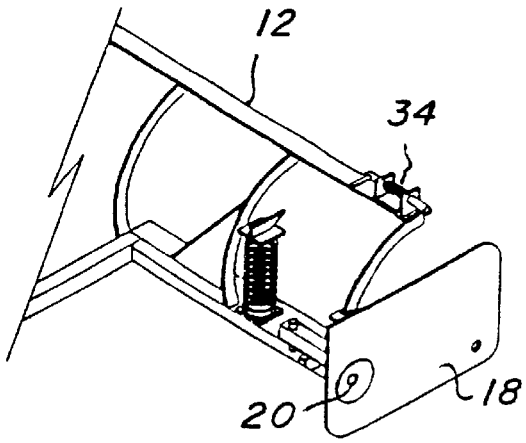
FIGS. 3A to 3D are somewhat schematic views at a perspective corresponding to FIG. 2 but to a smaller scale showing different operative positions of the attachment.
Figure 3B:
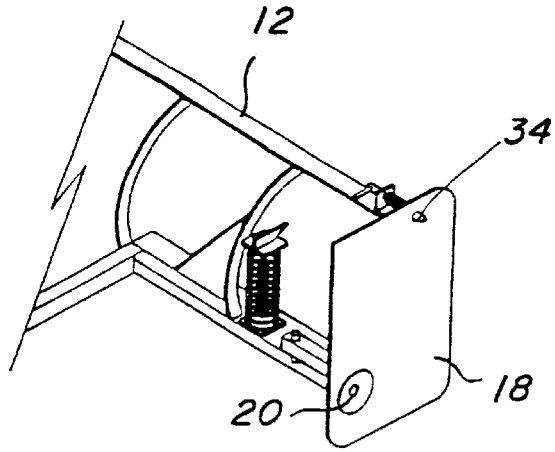
Figure 3C:
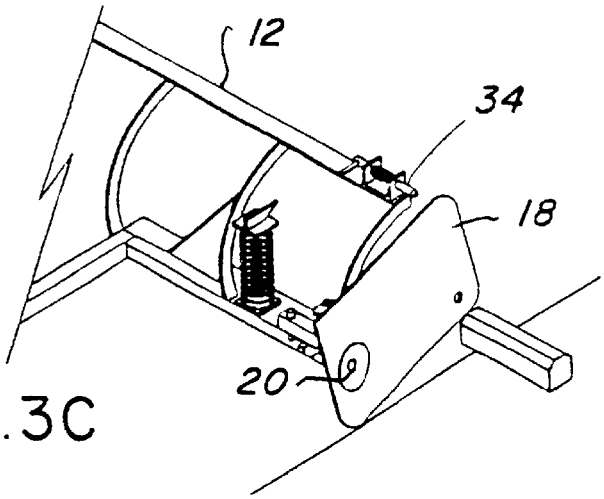
Figure 3D:
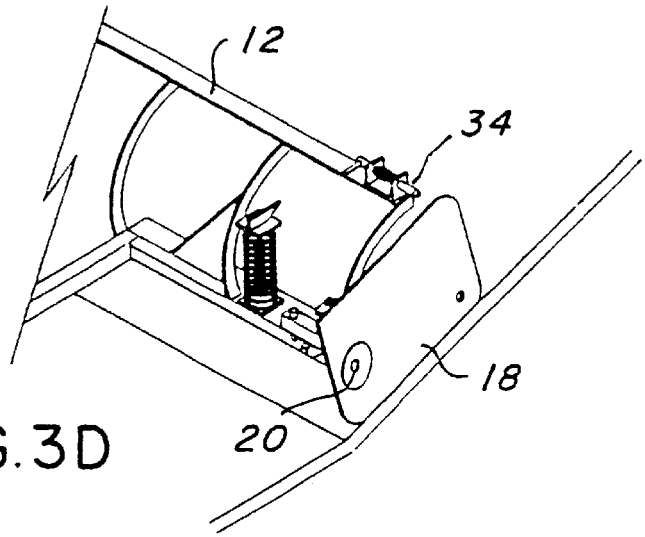

As best seen in FIG. 2, a spring-loaded latch pin 34 is positioned at the top corner of the blade 12 and is urged horizontally outwardly by an associated spring 36. In the front part of the plate 18 is a socket in the form of a hole 38 sized to receive the latch pin 34 and located in a registering position such that when the plate 18 is pivoted upwardly through a range of 90° from its deployed position, the hole 38 comes into register with the latch pin 34 so that the plate can be latched in its upstanding retracted position. In this connection it is noted that the front end of the latch pin is chamfered as at 34A such that when contacted by the upper edge 19 of the plate as the latter is swung upwardly, the latch pin 34 is cammed aside axially to permit continued movement of the plate, the latch pin automatically engaging the hole when the latter is moved into register with it.

From the foregoing it will be appreciated that in operation, with both of the plates 18 in the horizontally deployed position, the snowplow blade can push in front of it a very large quantity of snow. Without the plate 16, the quantity of snow that could be moved would be severely limited by escape of snow from both ends of the snowplow blade 12. This problem is counteracted by the deployed plates 18 since they delimit a very large volume in front of the blade 12, so that no snow will escape from the blade laterally until after this volume has been completely filled and an additional volume has accumulated in front of it. For a typical truck-mounted snow blade as shown in FIG. 1 having a height of 28 inches and a length of 96 inches, attachment plates 18 of a size 18×30 inches, will easily increase the snow pushing capacity, i.e. the amount of snow that can be carried in front of the blade without spilling from the sides thereof, by at least about 100%.

It will be understood that the attachments 16 can be used singly or in unison. In some situations it may be desirable to displace snow laterally to one side of the snowplow blade, and in that event the apparatus would be operated with the plate 18 on that side in its retracted position. In other situations it may be desirable to operate the snowplow blade 12 with both of the plates 18 in the retracted position e.g. when the blade 12 is employed in a reverse mode to draw snow or ice away from a wall.

The vastly increased capacity of the snowplow blade in moving snow is achieved without increasing the length (i.e. the transverse dimension) of the blade so that the blade as disclosed can still be operated in relatively restricted confines, e.g. when clearing snow from vacant bays between parked cars in a parking lot, or in narrow laneways etc.

Further embodiments of the invention are shown in FIGS. 4 through 7, these embodiments showing the attachment of the invention provided on the bucket of a wheeled loader. The loader 40 is shown in FIG. 4A and is of well known form including a large capacity bucket 42 of D-shaped profile which is carried on a powered linkage 44 by means of which the bucket can be tilted, raised and lowered. FIG. 4A shows in broken lines how the bucket can be manipulated about a horizontal axis 46 by the linkage 44. As shown particularly in FIGS. 5 and 6, in this embodiment an attachment plate 118 is mounted on each side of the bucket 42. Specifically, an elongate mounting plate 48 is secured to each D-shaped cheek plate 50 of the bucket 42 by threaded fasteners such as heavy duty bolts 56 two of which are mounted near the rear and two near the front of the bucket as shown in FIGS. 5B, 5C and 5D. Additionally, the mounting plate 48 carries a pair of laterally projecting lugs 58 (FIGS. 5C, 5D) which abut at spaced apart locations against the front of the reinforced edge 52 of the bucket and help to support the plate against rearwardly directed loads.

Figure 5A:
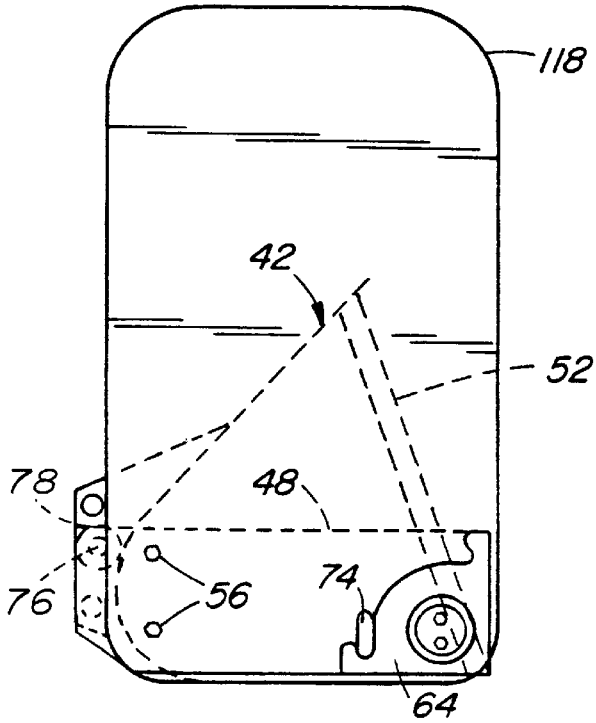
FIGS. 5A and 5B are side views showing the attachment mounted on a loader bucket.
Figure 5B:
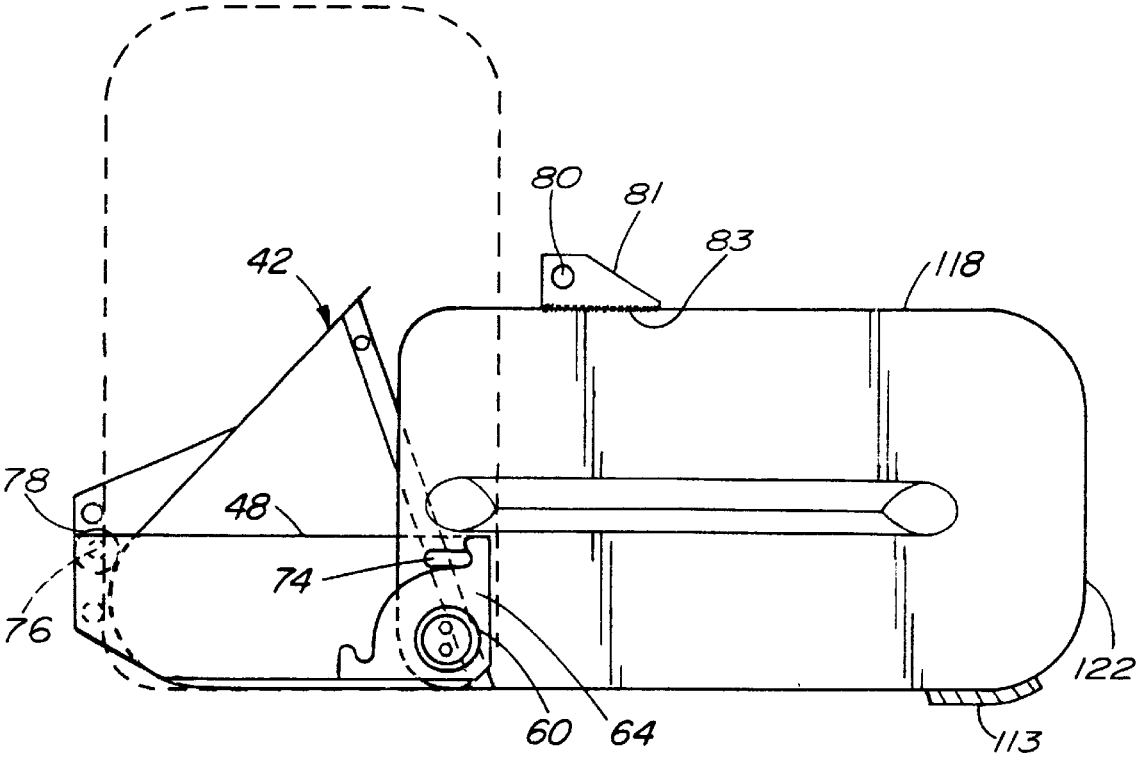
Figure 5D:
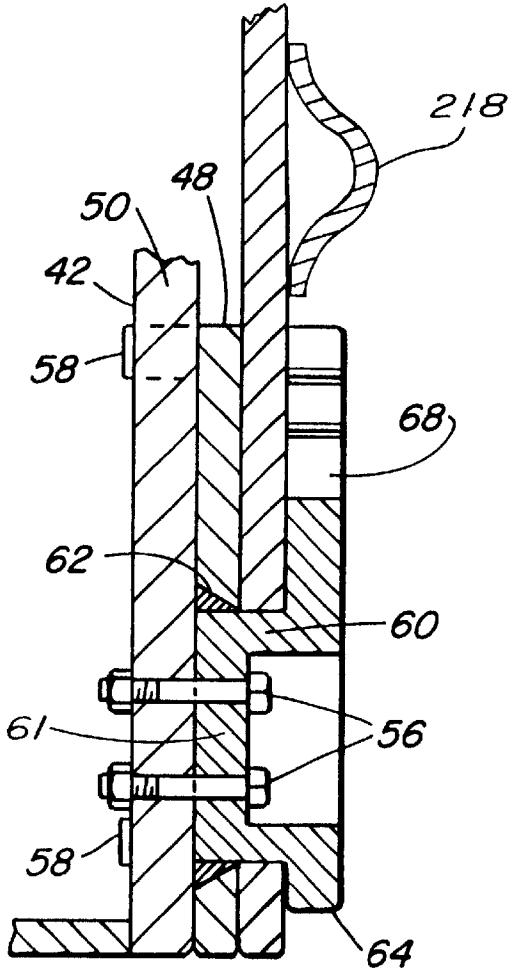
FIG. 5D is a sectional view taken on the line VD—VD in FIG. 5C.
Figure 5C:
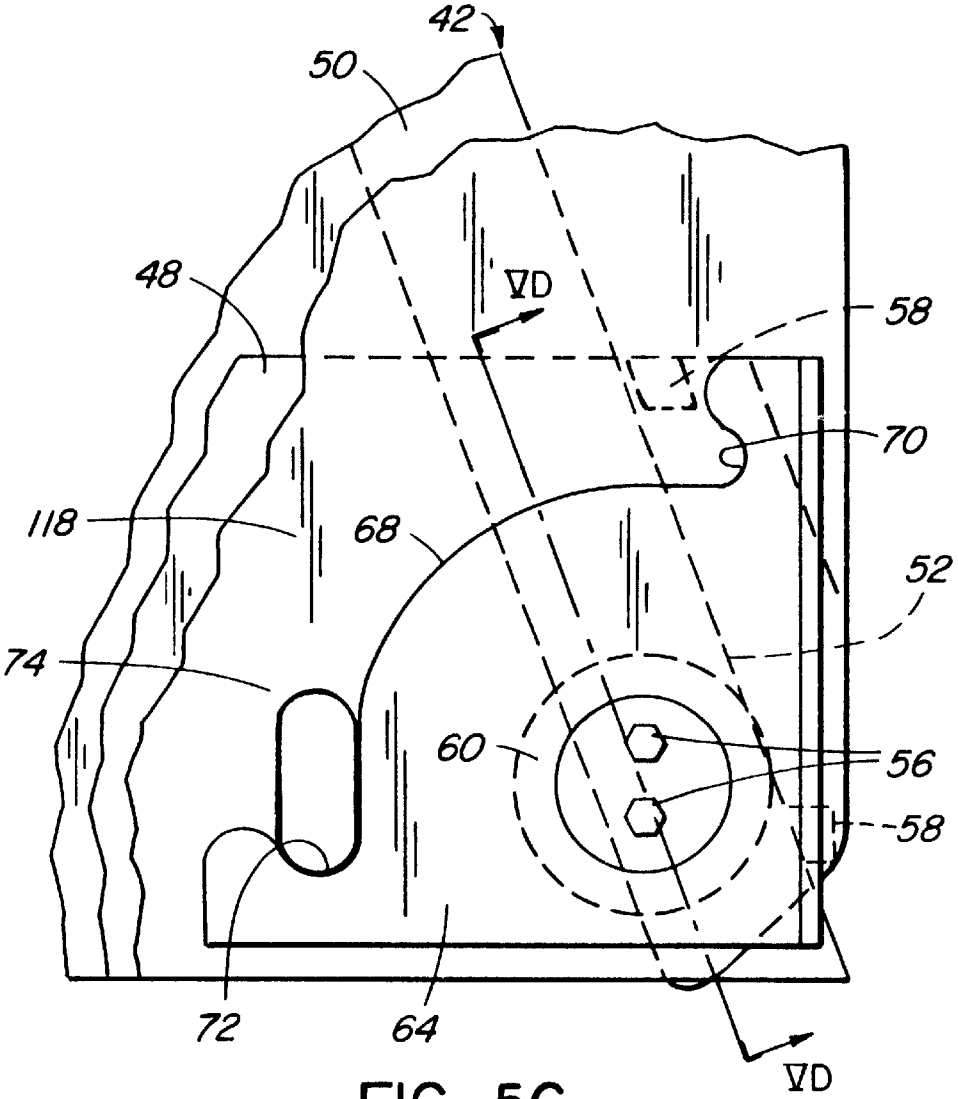
FIG. 5C is an enlarged view of a portion of FIG. 5A.

As shown in FIGS. 5C and 5D, the attachment plate 118 lies flat against the mounting plate 48 and is guided for pivotal movement about the axis of a large diameter bearing ring 60 which is securely fixed to the mounting plate 48 by an annular welding bead 62. The bearing ring has an integral circular end wall 61 which lies against the bucket cheek 50 as is secured thereto by two of the threaded bolts 56 which penetrate aligned holes in the wall 61 and in the bucket cheek 50. The bearing ring 60 has a large outside diameter, e.g. from 4 to 12 inches, and has a short axial length and is formed integrally with an abutment plate 64 located at the laterally outer end of the bearing ring 60 and which serves to retain the plate 118 on the bearing ring 62 against the outer surface of the plate 48. From the foregoing it will be evident that the bolts 56, as well as providing a secure attachment of the front end of the mounting plate 48 to the bucket, also provide a secure mounting for the abutment plate 64, the latter confining the plate 118 against the mounting plate 48 while providing adequate clearance to enable pivoting of the plate 118 about the outer cylindrical surface of the bearing ring 60. The plate 64, as best seen in FIG. 5C has a generally arcuate edge surface 68 at opposite ends of which are defined rounded notches 70, 72. The notches cooperate with a solid lug 74 which is welded on the plate 118 and define limiting positions in the range of pivotal movement of the plate about the bearing ring 60. The notches 70, 72 co-act with the lug 74 to define a range of pivotal movement of the plate of about 90° from a deployed position as shown in FIG. 5B wherein the plate extends substantially horizontally forwardly, to a retracted position shown in FIG. 5A wherein the plate 118 extends vertically upwardly to the rear of the lower edge of the bucket.

As with the embodiment of FIGS. 1 to 3, the attachment plate 118 has a rounded large radius lower front corner 122 to enable the plate to pivot upwardly from its deployed position when an obstacle is encountered. The lower front edge portion of the plate 118 will be subject to wear through contact with the ground surface, and to reduce this wear, a carbide runner 113 is provided along the lower front edge portion of the plate 118. This carbide runner is formed of short sections of carbide welded, brazed or otherwise attached to the plate 118.

To retain the plate 118 in its retracted position a latching arrangement is provided comprising a laterally projecting latching pin 76 (FIGS. 5A, 5B) carried on a power actuator 78 mounted on the plate 48 and positioned at the rear of the bucket 42 and connected for operation from the cab of the loader vehicle 40. In the embodiment shown the actuator 78 is air powered, the pin 76 being spring-loaded towards its extended position from which it can be withdrawn under the control of an air supply delivered to the actuator. Obviously other types of fluid-powered, electrical or mechanical actuators could also be employed. An aperture 80 is positioned on the plate 118 so as to lie in register with the latching pin 76 when the plate occupies its retracted limiting position as shown in FIG. 5A, in which position the latching pin 76 can be extended by the actuator 78 to latch the plate in the retracted position. When the pin 76 is withdrawn, the plate 118 is freed for movement between its two limiting positions. It will be understood that the precise location of the aperture 80 will depend upon the location of the pivot axis and of the latching pin 76, and these locations will to some extent be determined by the physical characteristics of the bucket 42 upon which the attachment is to be mounted. To accommodate various possibilities in the positioning of the latching pin 76, the aperture 80 is provided in a lug plate 81 which is designed to be attached to the plate 118 as by welding 83 once the position of the actuator 78 has been established.

Figure 4A:
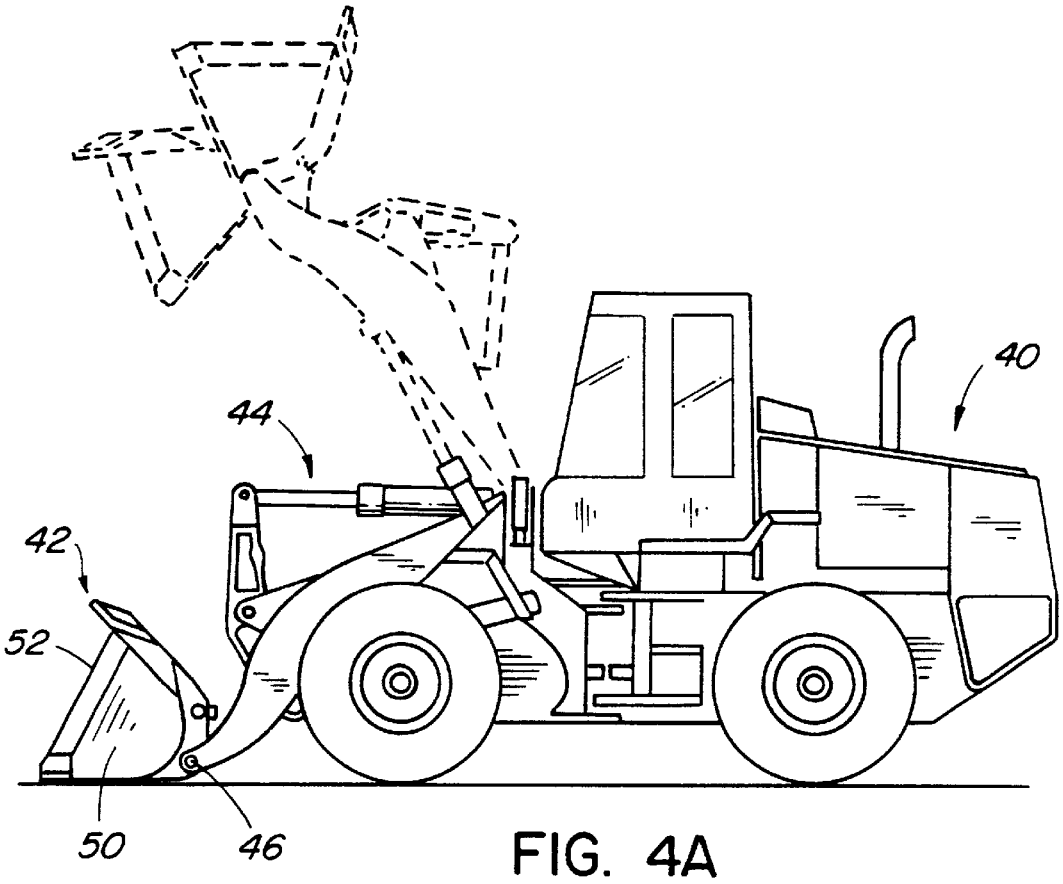
FIG. 4A is a side view of a bucket loader indicating the range of movement of the bucket thereof.
Figure 4B:
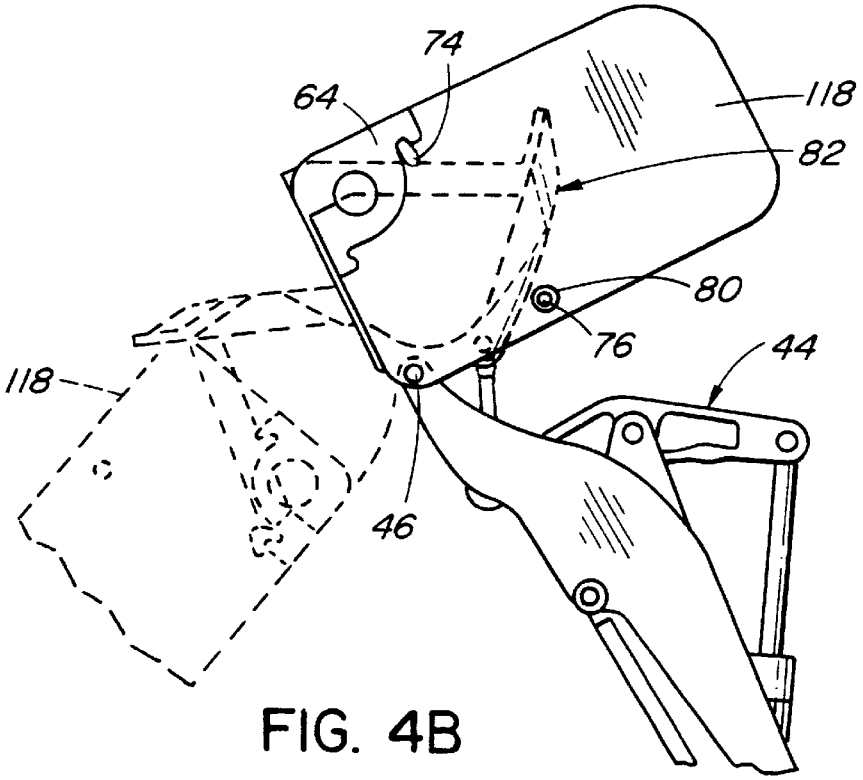
FIG. 4B is a slightly enlarged fragmentary view indicating movement of the bucket of the loader.

In the deployed position of the plate as shown in FIG. 5B, the plate is freely pivotable upwardly about the bearing ring 60 so that the front end of the plate can rise when an obstacle such as a kerb stone, or a change in grade is encountered. Movement of the plate between its deployed and retracted positions can be effected by manipulation of the powered linkage 44 of the loader as will be appreciated from a consideration of FIG. 4B. With the latching pin 76 withdrawn, operation of the linkage 44 to swivel the bucket and the plate 118 counterclockwise from the position shown in full lines will cause the center of gravity 82 of the plate to swing to the left as illustrated so that once it has passed over the axis 46, the plate will be urged by gravity to move towards its deployed position as shown in broken lines in FIG. 4B. Similarly, reverse pivoting movement of the bucket 42 about the axis 46 will restore the plate from the deployed position to the retracted position.

The plates 118 at opposite ends of the loader bucket 42 can be operated independently so that the bucket can be utilized in the configuration where one plate is deployed and the plate at the opposite side of the bucket is retracted.

Figure 7:
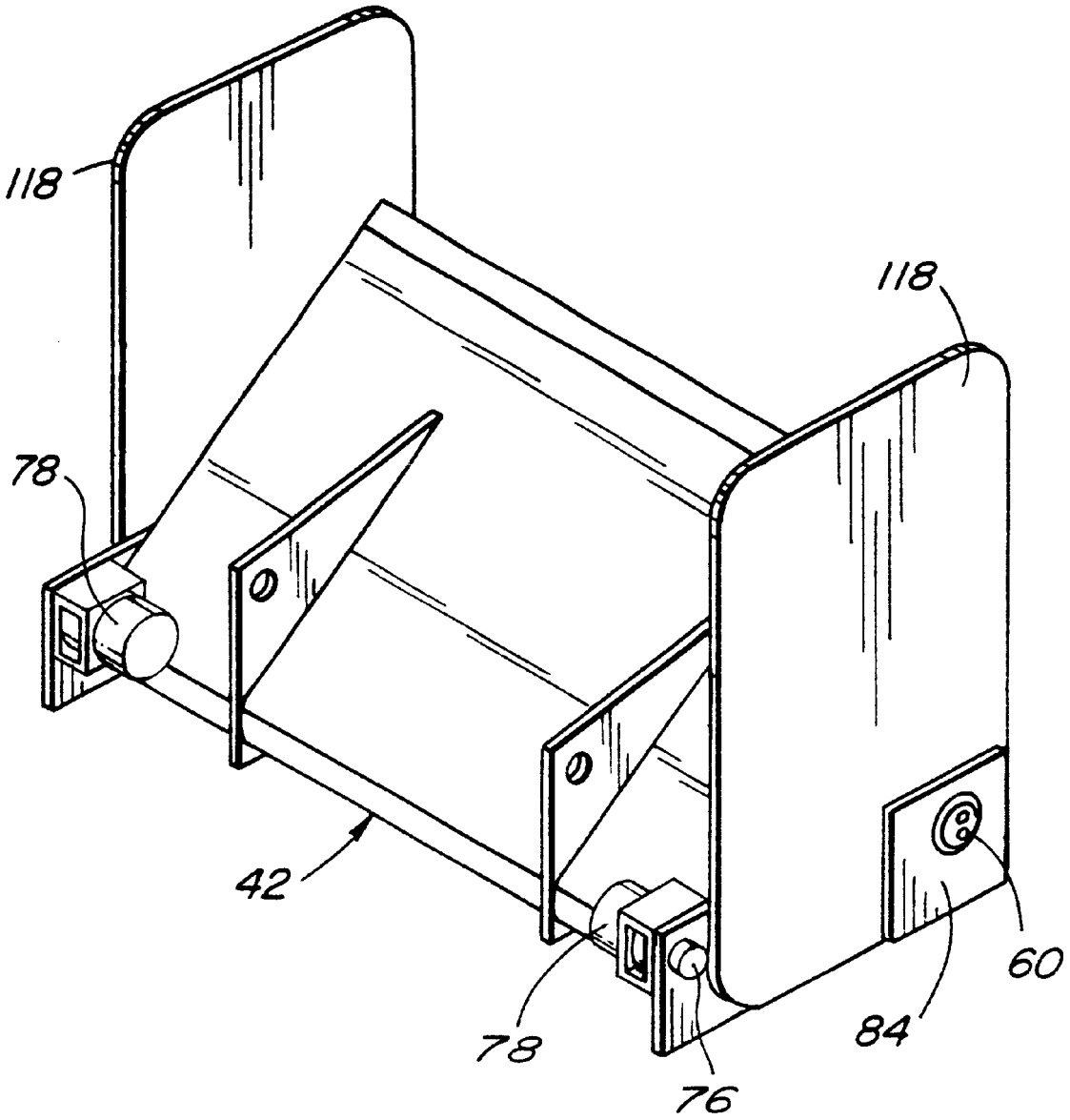
FIG. 7 is a rear perspective view corresponding to FIG. 5A showing a modified attachment.

A modified arrangement of the abutment means for delimiting the range of pivotal movement of the plates 118 is shown in FIG. 7. In this arrangement, there is an abutment plate 84 the outside of which is of rectangular outline. The plate 118 is formed with an arcuate slot (not shown) coaxial with the bearing ring 30, this arcuate slot cooperating with a lug (not shown) fixed to the inner side of the plate 84 to delimit the range of pivotal movement of the plate 118 between the deployed and retracted positions.

Figure 6:
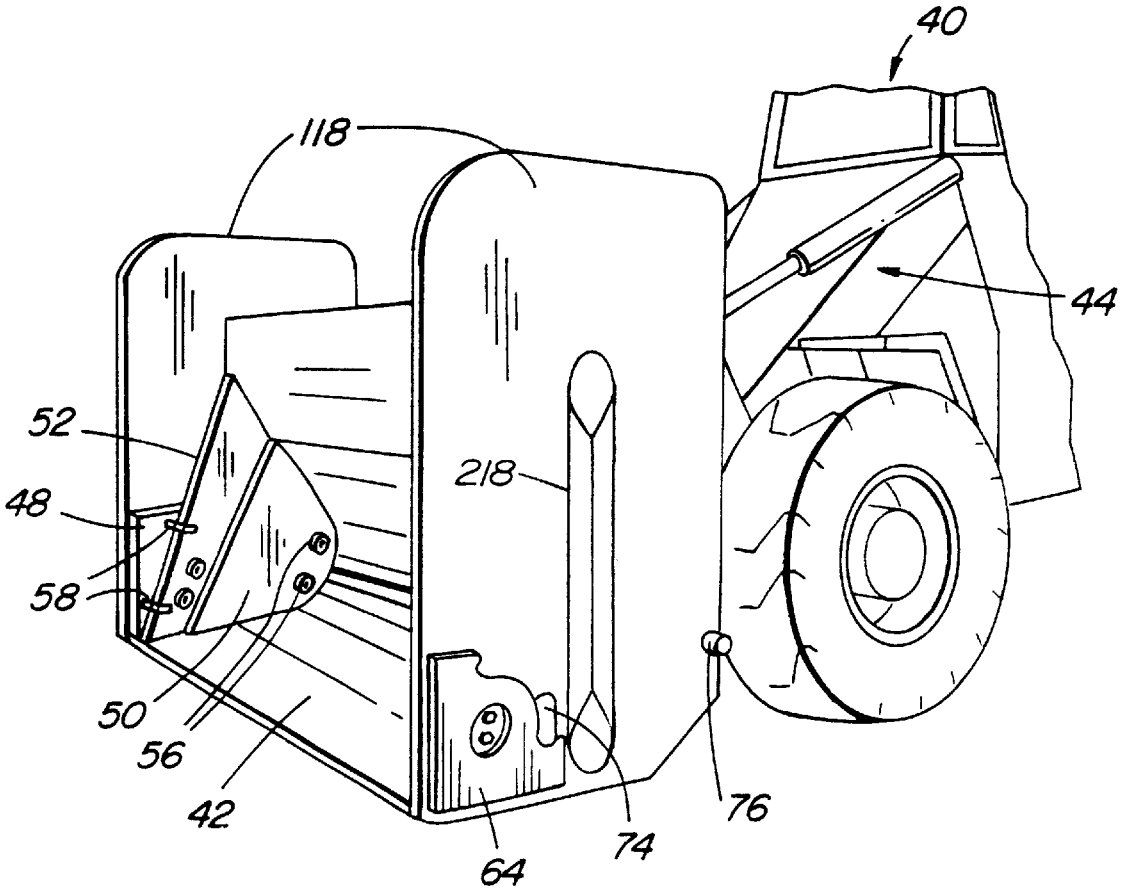
FIG. 6 is a somewhat schematic perspective view of the attachments mounted on a loader bucket.
Figure 8:
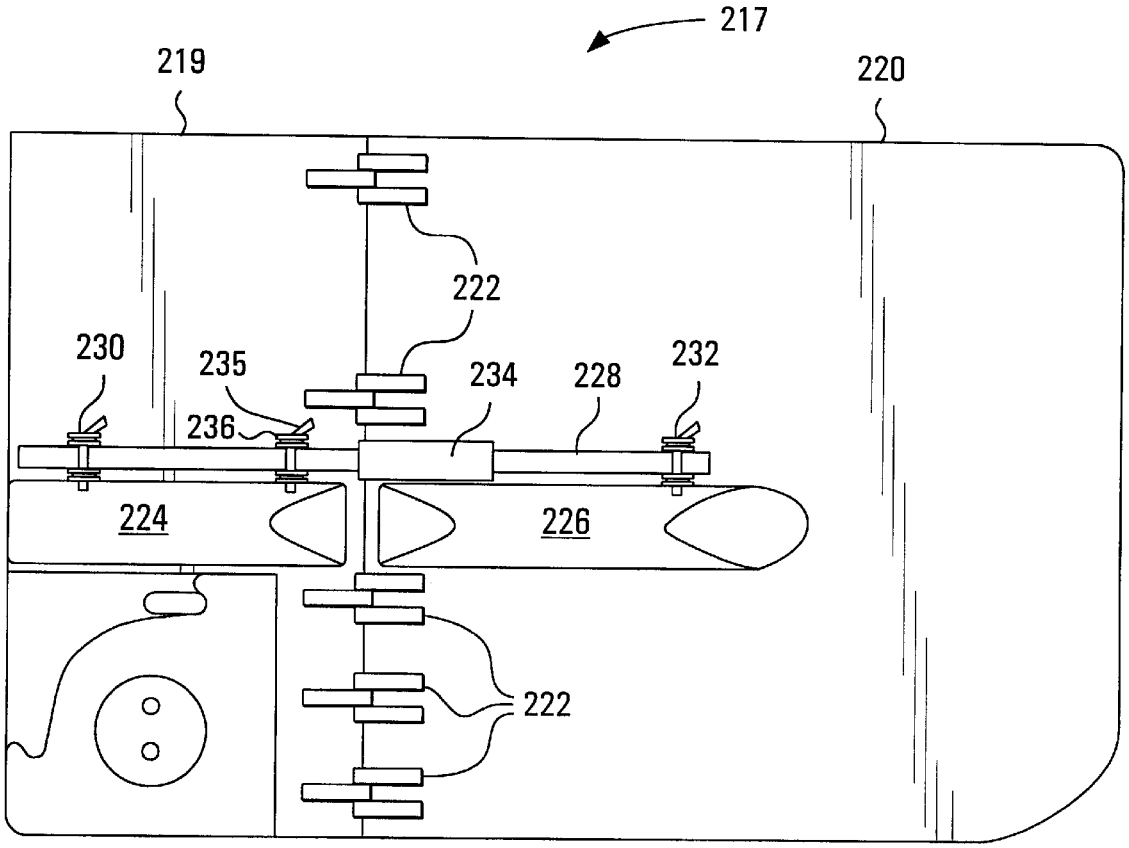
FIG. 8 is a side elevation of a modified attachment plate.
Figure 9:
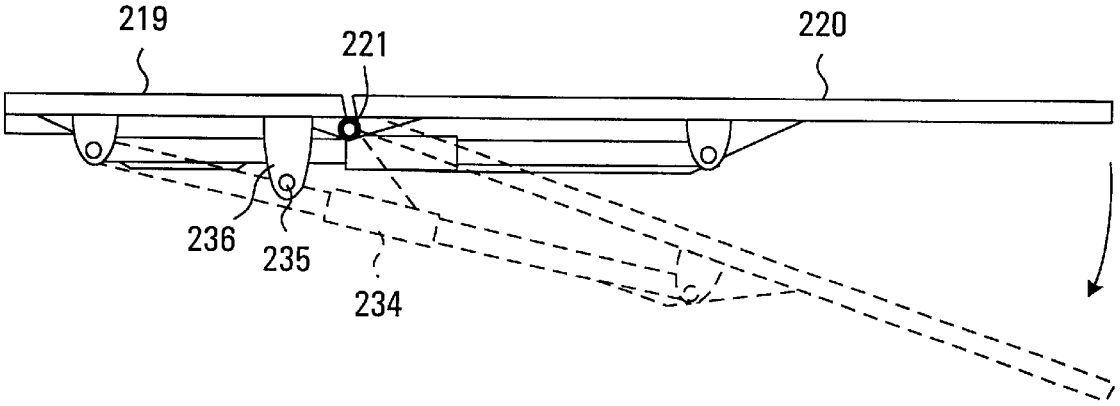
FIG. 9 is a plan view of the modified attachment plate of FIG. 8.

The modified attachment plate 218 shown in FIGS. 8 and 9 is generally similar to that described in relation to FIGS. 5 and 6 but is modified to provide increased flexibility of use. It will be understood from the description and illustration of the previously discussed embodiments that in operation the attachment plates mounted at opposite sides of a snowplow blade or loading bucket will confine a swath of snow of a width corresponding to that of the blade or bucket. However where the snowfall to be cleared is light, i.e. about 6 inches or less, the capacity or power of the vehicle which drives the blade or bucket is under utilized, and particularly for use in these circumstances, the modified attachment plate arrangement 218 of FIGS. 8 and 9 is provided. Basically this embodiment accomplishes the object of widening the swath which can be cleared by the blade or bucket, and to this end the attachment plate 218 is sub-divided into a relatively short proximal mounting section 219 and a relatively larger distal section 220 which is pivotally attached to the mounting section on a pivot axis 221 that is established by a series of hinges 222 mounted on the plate sections 219 and 220. Each of the sections 219, 220 has on the outer surface thereof a longitudinally extending stiffening rib 224, 226 respectively.

The distal section 220 of the blade can be pivoted between the coplanar position relative to the mounting section 210 as shown in full lines in FIG. 9, and to an angulated position, shown in broken lines. To control the attitude of the plate section 220, an elongate rigid strut 228 is provided, this strut being pivotally attached at opposite ends to brackets 230, 232 on the plate sections 219, 220. The strut 228 includes a length adjusting mechanism 234 which can be actuated to extend the strut to its full length as shown in FIG. 8 or retract it as indicated in broken lines in FIG. 9 to effect outwards pivotal movement of the distal plate section 220. The distal section 220 can be locked in the coplanar position shown by means of a pin 235 passed through the jaws of a bracket 236 in which the strut 228 is received, to prevent pivotal movement of the strut about its rear end.

It should be noted that angulation of the distal portion 220 of the plate 217 as shown in FIG. 9 does not interfere with the ability of the plate 217 to pivot upwardly away from the deployed position when an obstacle is encountered.

The length adjusting mechanism 234 can be provided in various forms, e.g. as a pneumatic or hydraulic actuator, or as a mechanical actuator such as a turnbuckle.

In an alternative configuration (not shown) the strut 228 can be of fixed length with its forward end adapted for attachment to auxiliary brackets (not shown) spaced longitudinally towards the hinge 221.

By such means as described above in relation to FIGS. 8 and 9 it is possible to widened the effective swath of ground that is cleared by a bucket or snow blade provided with such attachment plates by up to 50%. This feature greatly increases the productivity of the operating vehicle in light snow fall conditions.

The attachment is fabricated from any suitable material. Typically the components will be made from various grades of tempered steel which may be fabricated by cutting and interconnected by welding.

The plates 118 can be of very large size, and in the example shown as mounted on a heavy duty bucket loader the plates have an overall length of 84 to 96 inches and a width of 48 to 60 inches. Due to their large extent and the fact that they are supported in operation at just one end, it is desirable to provide stiffening reinforcement on these plates to reduce the amount of flexure thereof in operation. As shown, the plates are of steel sheet (temper plate T1, or Algoma QT) of thickness 0.75 inches and are stiffened by a welded in place longitudinally extending V-shaped rib 218 (FIG. 6) formed of 5/16 inch steel plate. The rib 218 has a length of approximately 54 to 72 inches or 80% of the length of the plate 118, and a width of 7 to 9 inches and is welded around its edges to the outer side of the associated plate 118 to provide the latter with a desired degree of rigidity without excessively adding to its weight.

The plates 118 as shown in FIGS. 4 to 7 will have considerable weight, particularly when used on large capacity loader buckets, and in these circumstances it may be desirable to provide a damper to prevent excessive impacts occurring between the abutment blade 64 and the lug 74 when the plate 118 is swung between its limiting positions as shown in FIG. 4B by rotation of the bucket 42. For this purpose the pivot mechanism can include a fluid damper (not shown) which will offer strong resistance against rapid movement of the plate 118 to either of its limiting positions, but which will offer very little resistance to slow movement of the plate 118. The fluid damper mounting will include lost motion means to enable rapid upwards movement of the plate 118 from its deployed position shown in FIG. 5, in the event that the plate encounters an obstacle such as a curb stone.

In some circumstances e.g. for particularly heavy plates 118 and where independent control of the position of these plates at opposite sides is desired, a powered actuator can be provided. For example there could be provided for each plate 118 a linkage controlled by a fluid motor such as an air bag or hydraulic cylinder effective to swing the plate 118 throughout its range of pivotal movement, the linkage including a lost motion arrangement such as a pin and slot to enable upwards pivotal movement of the plate from its deployed position as described above. With this arrangement the bucket can be operated selectively with both plates deployed, both plates retracted, or with only one of the plates deployed.

Although shown only in FIG. 6, reinforcing ribs can and preferably will be provided on all embodiments of the invention including that of FIGS. 1 to 3. Such ribs are readily fabricated and installed and provide significant advantages in providing the plates with an adequate degree of stiffness with little increases in weight. Of course the stiffening ribs can be provided in many forms other than the straight configuration illustrated in FIG. 6.

The attachments discussed in the foregoing can also be provided in kit form to be retrofitted onto existing snowplow blades and loader buckets. For example in the embodiment of FIGS. 1 to 3 the kit would comprise a pair of plates 18, pivot pins 20 and attachment sleeves 26 together with the latch pin assembly 34, 36.

For the embodiment of FIGS. 4 to 6 an installation kit for the attachment would comprise a pair of mounting plates 48 each with its associated bearing ring 60, abutment plate 64, plate 118 and latching arrangement 76, 78, together with the associated hardware for connecting the attachment to the bucket 42. In some situations it is envisaged that the lower front portion of the bucket cheek will be removed and replaced by a welded in situ stiffened reinforcing plate to provide a more solid support for the mounting plate 48 of the attachment.

As mentioned in the foregoing, particularly for installation upon loader buckets, it is desirable not to encroach upon the interior space of the bucket. Likewise it is desirable to avoid excessive added thickness in the transverse direction of the bucket. To this end the bearing ring 60 is minimized in its axial length and is preferably no more than about 1.5 inches, and more preferably no more than 0.5 to about 1 inch in this dimension. The small axial length of the bearing means that the increase in width of the bucket at each side amounts to no more than about 1.5 to 3 inches, so that the attachment does not interfere greatly with normal operation of the bucket. To provide an adequate bearing surface for engagement by the bore in the plate 118, the outside diameter of the bearing ring 60 will be at least 4 inches, and preferably from 6 to 12 inches depending upon the application.

While certain exemplary embodiments of the invention are shown in the drawings and described above, it will be appreciated that the invention is susceptible of many variations in the details thereof and is not limited to the precise details disclosed, but rather encompasses all such arrangements as fall within the scope of the appended claims.

I claim:

1. An attachment for mounting on an end of a transversely elongate implement that is useful for pushing loose friable material across a ground surface, said attachment being deployable to increase the material-handling capacity of said implement and comprising:

a mounting bracket adapted to be fixed on one end of said implement to define a horizontal pivot axis that is generally parallel to the length of said implement;

a plate pivotally carried on said mounting bracket and being constructed and arranged for selectively positioning in a deployed, operative position for use and in a retracted, inoperative position for non-use, in said deployed, operative position said plate being freely pivotable about said horizontal pivot axis through a predetermined range of angular movement from said deployed, operative position in the direction of said retracted, inoperative position, in said retracted, inoperative position said plate being secured so as to prevent angular movement of said plate, said plate in use being positioned outboard of and with a major face thereof closely adjacent said one end of the implement; and abutment means operatively associated with said plate and said mounting bracket and positioned to delimit said range of angular movement.

2. An attachment as claimed in claim 1 wherein said plate has:

a length; a height that is less than said length; and a longitudinal edge that is generally straight and that in use constitutes a lowermost edge of said plate and lies adjacent the ground surface, said longitudinal edge extending between a forward end and a rear end of said plate and said pivot axis being positioned in the vicinity of said rear end, said plate at the forward end thereof defining a large rounded corner that merges with said longitudinal edge.

3. An attachment as claimed in claim 1 wherein said abutment means delimits said angular movement to a range of at least 90°.

4. An attachment as claimed in claim 1 including latching means selectively engageable to latch said plate in said retracted, inoperative position that is angularly displaced from said deployed, operative position.

5. An attachment as claimed in claim 4 wherein said latching means is adapted to engage automatically upon movement of the plate to said retracted, inoperative position.

6. An attachment as claimed in claim 4 wherein said retracted, inoperative position is displaced by about 90° from said deployed, operative position and is defined by said abutment means, said latching means being spring-loaded to an engage automatically upon movement of said plate to said retracted, inoperative position.

7. An attachment as claimed in claim 4 wherein said retracted, in operative position is displaced by about 90° from said deployed, operative position and is defined by said abutment means, and including a powered actuator selectively operable to move said latching means between a disengaged and an engaged condition thereof.

8. An attachment as claimed in claim 7 wherein said latching means comprises a power driven pin that is remotely selectively actuatable to move to and from the engaged condition thereof.

9. An attachment as claimed in claim 1 wherein said plate comprises proximal and distal sections that are pivotally interconnected about an adjustment axis which is at right angles to said pivot axis and which in said deployed, operative position extends in a generally upright direction, adjustment means attached between said proximal section and said distal section and being operative to effect pivotal movement of said distal section relative to said proximal section about said adjustment axis between a position wherein said two sections are substantially coplanar and a position wherein said distal section is angled outwardly forwardly when said attachment is in the deployed, operative position.

10. An implement useful for pushing loose friable material across a ground surface, said implement being transversely elongate and having spaced lateral ends at each of which is mounted an attachment as claimed in claim 1.

11. An implement as claimed in claim 10 comprising a snowplow blade having a front surface that is convex from top to bottom and a correspondingly shaped rear surface, at each end of said rear surface there being attached a horizontal sleeve which constitutes said mounting bracket, said sleeve receiving a coaxial pivot pin that is carried on the corresponding plate.

12. A snowplow blade as claimed in claim 11 wherein said plate is of generally rectangular shape, having opposed front and rear edges, said pivot pin being mounted close to said rear edge, such that in its retracted, inoperative position said plate extends mainly rearwardly and upwardly with respect to said implement.

13. An implement as claimed in claim 10 comprising a large capacity bucket for mounting on a mobile loader, said bucket having a generally D-shaped cross-section defining transverse horizontal upper and lower edges between which extends a channel-shaped body closed at its opposite ends by D-shaped cheeks, and wherein each said mounting bracket comprises a mounting plate that is fixed to a respective one of said cheeks and which has an outer side on which is defined said mounting bracket upon which the respective plate is pivotally supported for movement towards and way from the deployed, operative position thereof.

14. A bucket as claimed in claim 13 wherein each said mounting bracket is secured to the associated cheek at a location adjacent a forward edge of said cheek and at a location adjacent a rearward end of said cheek.

15. A bucket as claimed in claim 13 wherein said mounting bracket defines a bearing surface for said plate, said bearing surface having a diameter that is at least four times the axial length thereof.

16. A bucket as claimed in claim 15 wherein the diameter of said bearing surface is between 6 and 12 times said axial length thereof.

17. A truck comprising at a front end thereof a transversely oriented snowplow blade, said snowplow blade having at each opposite end thereof an attachment as set forth in claim 1.

18. An attachment for mounting on an end of a transversely elongate implement that is useful for pushing loose friable material across a ground surface, said attachment being deployable to increase the material-handling capacity of said implement and comprising:

a mounting bracket adapted to be fixed on one end of said implement to define a horizontal pivot axis that is generally parallel to the length of said implement;

a plate pivotally carried on said mounting bracket and being constructed and arranged for selectively positioning in a deployed, operative position for use and in a retracted, inoperative position for non-use, said plate including a first edge, a second edge, and a rounded comer therebetween, said first edge being forwardly facing with said plate in said deployed, operative position and said second edge being forwardly facing with said plate in said retracted, inoperative position, in said deployed, operative position said plate being freely pivotable about said horizontal pivot axis through a predetermined range of angular movement between said deployed, operative position and said retracted, inoperative position, in said retracted, inoperative position said plate being secured so as to prevent angular movement of said plate, said plate in use being positioned outboard of and with a major face thereof closely adjacent said one end of the implement; and abutment means operatively associated with said plate and said mounting bracket and positioned to delimit said range of angular movement.

19. An attachment for mounting on an end of a transversely elongate implement that is useful for pushing loose friable material across a ground surface, said attachment being deployable to increase the material-handling capacity of said implement and comprising:

a mounting bracket adapted to be fixed on one end of said implement to define a horizontal pivot axis that is generally parallel to the length of said implement;

a plate pivotally carried on said mounting bracket for free pivotal angular movement about said horizontal pivot axis through a predetermined range, said plate in use being positioned outboard of and with a major face thereof closely adjacent said one end of the implement;

abutment means operatively associated with said plate and said mounting bracket and positioned to delimit said range of angular movement and define a first limiting position wherein said plate in operation occupies a deployed position in a generally upright plane in close proximity to the implement end and with a major part of said plate at an attitude projecting forwardly of said implement, said plate in use being freely pivotable upwardly from said deployed position; and latching means selectively engageable to latch said plate in a retracted position that is angularly displaced from said deployed position, said latching means being adapted to engage automatically upon movement of said plate to said retracted position.

20. A vehicle comprising a horizontally oriented bucket of D-shaped profile, said bucket being carried upon an adjustable linkage which is operable to effect lifting and lowering movements of the bucket, and also to effect tilting movements of the bucket about a horizontal axis located to the rear of the bucket, each end of said bucket comprising a D-shaped cheek plate, each said cheek plate having attached thereto a mounting bracket in the form of a plate rigidly secured to the cheek plate, said mounting bracket having on a lateral outward side thereof in the vicinity of the lower edge of the bucket an annular bearing surface adapted to support a complementary bearing surface formed in an attachment plate that is arranged in a vertical orientation adjacent and in overlapping relation to the respective bucket end, said attachment plate being freely pivotable about said bearing surface; abutment means associated with each said mounting plate and said attachment plate respectively and defining a range of pivotal movement of said attachment plate relative to said mounting plate, one end of said range defining a deployed position for said attachment plate wherein it extends generally forwardly of said bucket, and a second end of said range defining a retracted position of said attachment plate wherein it projects upwardly and rearwardly relative to the lower edge of said bucket, said attachment plate when in said deployed position being freely pivotal in one direction upwardly about said bearing surface, said vehicle further including power actuated latching means for engaging said attachment plate in said retracted position.

* * * * *

UNITED STATES PATENT AND TRADEMARK OFFICE

CERTIFICATE OF CORRECTION

PATENT NO. : 6,240,660 B1
DATED : June 5, 2001
INVENTOR(S) : Gerard F. Dugas

It is certified that error appears in the above-identified patent and that said Letters Patent is hereby corrected as shown below:

Column 1,
Line 42, change "moneuverability" to -- maneuverability --.

Column 9,
Line 32, delete "an".

Signed and Sealed this

Ninth Day of April, 2002

*Attest:*

*Attesting Officer*

JAMES E. ROGAN
*Director of the United States Patent and Trademark Office*